US007309123B2

(12) United States Patent
Anami et al.

(10) Patent No.: US 7,309,123 B2
(45) **Date of Patent: *Dec. 18, 2007**

(54) RECORDING APPARATUS

(75) Inventors: Akira Anami, Nagano-ken (JP); Narihiro Oki, Nagano-ken (JP); Takayuki Shiota, Nagano-ken (JP); Kazuo Otsuka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 370 days.

This patent is subject to a terminal disclaimer.

(21) Appl. No.: 10/911,124

(22) Filed: Aug. 3, 2004

(65) Prior Publication Data

US 2005/0007435 A1 Jan. 13, 2005

Related U.S. Application Data

(63) Continuation of application No. 10/395,642, filed on Mar. 24, 2003, now Pat. No. 6,814,436.

(30) Foreign Application Priority Data

Mar. 25, 2002 (JP) ..... 2002-82990
Mar. 6, 2003 (JP) ..... 2003-60688

(51) Int. Cl.
*B41I 2/01* (2006.01)

(52) U.S. Cl. ..... 347/104; 347/101; 347/16

(58) Field of Classification Search ..... 347/104, 347/101, 16, 105; 400/48, 641
See application file for complete search history.

(56) References Cited

U.S. PATENT DOCUMENTS 5,646,653 A 7/1997 Fujioka et al.
5,980,011 A 11/1999 Cummins et al. ..... 347/4
6,007,194 A 12/1999 Yokoyama et al. ..... 347/104
6,074,053 A 6/2000 Kawaura ..... 347/104
6,814,436 B2 * 11/2004 Anami et al. ..... 347/104
6,854,843 B2 * 2/2005 Anami et al. ..... 347/104

FOREIGN PATENT DOCUMENTS

JP 2002-192782 7/2002

OTHER PUBLICATIONS

European Search Report dated Sep. 29, 2005.

* cited by examiner

*Primary Examiner*—Lam Son Nguyen
(74) *Attorney, Agent, or Firm*—John J. Penny, Jr.; Edwards Angell Palmer & Dodge LLP

(57) ABSTRACT

A recording apparatus includes: a feeder, provided in an upstream in a transfer path for transferring a medium, for feeding the medium to a downstream in the transfer path one by one, the medium being stacked at an angle; a recording head, provided in the downstream of the feeder, for performing recording for the medium; a carriage, on which the recording head is mounted, for reciprocating in a main scanning direction along a carriage guide axis; a transfer roller for transferring the medium by rotating, the transfer roller including a transfer-driving roller and a transfer-driven roller; a stacker having a medium-placed surface, the stacker being positioned at a first position allowing the medium to be substantially horizontally fed from the medium-placed surface to a position under the recording head and be substantially horizontally discharged from the position under the recording head onto the medium-placed surface, or a second position for receiving and stacking the medium fed by the feeder, the second position being on a lower level than the first position, the medium-placed surface being arranged substantially horizontally when the stacker is positioned at the first position and is arranged at an angle when the stacker is positioned at the second position; and a first link mechanism for displacing the stacker to cause the carriage guide axis to displace. The carriage guide axis can be displaced upward and is prevented from moving downward when the stacker is positioned at the first position.

19 Claims, 10 Drawing Sheets

RECORDING APPARATUS

This application is a continuation of U.S. application Ser. No. 10/395,642 filed on Mar. 24, 2003, now issued as U.S. Pat. No. 6,814,436.

This patent application claims priority from Japanese patent applications Nos. 2002-82990 filed on Mar. 25, 2002 and 2003-60688 filed on Mar. 6, 2003, the contents of which are incorporated herein by reference.

BACKGROUND OF THE INVENTION

1. Field of the Invention

The present invention relates to a recording apparatus for performing recording for recording medium or paper by emitting ink on the recording medium, such as an ink-jet type recording apparatus, and a liquid emitting apparatus for emitting liquid onto a medium to make the liquid adhere to the medium.

The term "liquid emitting apparatus" is used for referring not only to a recording apparatus, having an ink-jet type recording head for emitting ink from the recording head so as to perform recording for a recording medium, such as a printer, a copier and a facsimile machine, but also to an apparatus that causes liquid to adhere to a medium, corresponding to the recording medium in the above recording apparatus, by emitting the liquid selected depending on the use of the apparatus in place of the ink toward the medium from a liquid emitting head corresponding to the recording head in the above recording apparatus.

As the liquid emitting head, the following heads can be considered other than the above recording head: a color-material emitting head used for fabrication of a color filter for a liquid crystal display or the like, an electrode-material (conductive paste) emitting head used for forming an electrode in an organic EL display or a field-emission display (FED), a bioorganic compound emitting head used for fabrication of a bio-chip and a sample spraying head as a precision pipette.

2. Description of the Related Art

As an exemplary recording apparatus or liquid emitting apparatus is known an ink-jet type printer (hereinafter, referred to as a "printer"). A typical printer is shown in FIGS. 10A and 10B. The printer 200 includes a medium feeder 2 provided in the upstream of a transfer path for medium, as shown in FIGS. 10A and 10B. The medium feeder 2 holds one or more units of a medium, such as cut sheet or paper, that are stacked thereon to be at a certain angle with respect to the body of the printer and feeds one or more units of the medium one by one to the downstream of the feeding path. The printer 200 also includes: a carriage (not shown), arranged in the downstream of the feeder 2, for carrying a recording head mounted thereon that performs recording for the medium; and a transfer roller (not shown) for transferring the medium by rotating, which includes a transfer-driving roller and a transfer-driven roller.

The printer 200 is arranged to have the first and second transfer paths. On the first transfer path, one of more units of the medium, for example, one or more sheets of paper, that are stacked on the feeder 2 to be at a certain angle with respect to the body of the printer, are transferred toward the front side of the printer 200 one by one while being bent, so as to be discharged from the front side of the printer 200 in a substantially horizontal direction. On the second transfer path, a rigid medium that cannot be transferred on the above-mentioned first transfer path is substantially horizontally fed from the front side of the body 3 of the printer 200 so as to be discharged from the front side of the printer 200.

The second transfer path is used, for example, for performing recording for a rigid medium such as a CD-R (recordable compact disc). In this case, it is necessary to attach an exclusive discharge tray 202 that serves as a feeder tray used for manually feeding the rigid medium from the front side of the printer 200 toward the recording head and also serves as a discharge tray for receiving the rigid medium discharged after the recording, on the upper side of a discharge tray 201 that receives paper discharged after the recording.

Moreover, in order to perform recording for the rigid medium, it is necessary to adjust a distance between the rigid medium and the recording head by displacing the carriage for mounting the recording head thereon upward, thereby ensuring that the recording head is not in contact with the rigid medium. For achieving this object, the printer 200 includes a PG operation lever 203 for displacing a carriage guide axis to adjust a gap between the recording head and the recording medium. The PG operation lever 203 has to be operated by a user depending on the type of the medium, thus causing a trouble. In addition, even during a recording operation for the rigid medium, the PG operation lever 203 is operative. Thus, the PG operation lever 203 may be operated by an unexpected force so as to bring the carriage down, thereby bringing the recording head into contact with the rigid medium. In this case, the recording head may be damaged, as disclosed in Japanese Patent Application Laying-Open 2002-192782, for example.

SUMMARY OF THE INVENTION

Therefore, it is an object of the present invention to provide a recording apparatus and a liquid emitting apparatus, which are capable of overcoming the above drawbacks accompanying the conventional art. The above and other objects can be achieved by combinations described in the independent claims. More specifically, it is an object of the present invention to provide a recording apparatus and a liquid emitting apparatus that can ensures a distance between a recording head and a medium for which recording is performed in an appropriate manner and can perform high-quality printing. The dependent claims define further advantageous and exemplary combinations of the present invention.

According to the first aspect of the present invention, a recording apparatus comprises: a feeder, provided in an upstream in a transfer path for transferring a medium, operable to feed the medium to a downstream in the transfer path one by one, the medium being stacked at an angle; a recording head, provided in the downstream of the feeder, operable to perform recording for the medium; a carriage, on which the recording head is mounted, operable to reciprocate in a main scanning direction along a carriage guide axis; a transfer roller operable to transfer the medium by rotating, the transfer roller including a transfer-driving roller and a transfer-driven roller; a stacker having a medium-placed surface, the stacker being positioned at a first position allowing the medium to be substantially horizontally fed from the medium-placed surface to a position under the recording head and be substantially horizontally discharged from the position under the recording head onto the medium-placed surface, or a second position operable to receive and stack the medium fed by the feeder, the second position being on a lower level than the first position, the medium-placed surface being arranged substantially horizontally when the stacker is positioned at the first position and is arranged at an angle when the stacker is positioned at the second position; and a first link mechanism operable to displace the stacker to cause the carriage guide axis to displace, wherein the carriage guide axis is arranged to be displaced upward when the stacker is positioned at the first position, and is prevented from moving downward as long as the stacker is positioned at the first position.

According to the second aspect of the present invention, a recording apparatus for performing recording for a first type of medium and a second type of medium comprises: a feeder, provided in an upstream in a transfer path for transferring the first type of medium, operable to feed the first type of medium to a downstream in the transfer path one by one, the first type of medium being stacked at an angle; a recording head, provided in the downstream of the feeder, operable to perform recording for the first type of medium and the second type of medium; a carriage, on which the recording head is mounted, operable to reciprocate in a main scanning direction along a carriage guide axis; a transfer roller operable to transfer the first type of medium by rotating, the transfer roller including a transfer-driving roller and a transfer-driven roller; a stacker having a medium-placed surface, the stacker being positioned at a first position allowing another transfer path for the second type of medium to be formed or at a second position, located on a lower level than the first position, operable to receive and stack the first type of medium, the medium-place surface being arranged substantially horizontally when the stacker is at the first position and is arranged at an angle when the stacker is at the second position, the another transfer path allowing the second type of medium to be straightly fed from the medium-placed surface to a position under the recording head and be straightly discharged from the position under the recording head onto the medium-placed surface; and a first link mechanism operable to displace the stacker to cause the carriage guide axis to displace, wherein the carriage guide axis is displaced upward when the stacker is positioned at the first position, and is prevented from moving downward as long as the stacker is positioned at the first position, and the second type of medium is suitable for substantially straight transfer.

According to conventional techniques, in order to perform for a rigid medium that cannot be fed by a feeder for feeding paper as a recording medium, such as a CD-R, it is necessary to attach an exclusive feed-discharge tray for rigid medium, that serves not only as a feed tray used for manually feeding the rigid medium from the front side of a printer toward a recording head but also as a discharge tray used for receiving the rigid medium discharged after recording, above a discharge tray for paper that is used for receiving the paper discharged after recording.

Moreover, in a case of recording for the rigid medium, it is necessary for a user to operate a PG operation lever for displacing the carriage guide axis so as to adjust a gap between the medium and the recording head. However, operating the PG operation lever depending on the type of recording medium causes a trouble. In addition, during the recording for the rigid medium, the PG operation lever may be operated by an unexpected force externally applied, causing a carriage to move down so as to come into contact with the rigid medium. This may leads to a damage of the recording head.

According to the present invention, the first link mechanism for displacing the carriage guide axis by displacing the stacker for the medium is provided. Thus, the recording for the rigid medium such as a CD-R can be performed easily without fail. More specifically, by displacing the stacker to the first position, that is a position for recording for the rigid medium, the carriage guide axis is also displaced upward. Therefore, the recording head and the rigid medium cannot be brought into contact with each other, eliminating the necessity of the conventional PG operation lever. This reduces the operations that the user has to do.

Moreover, according to the present invention, the carriage guide axis is displaced upward with the movement of the stacker to the first position, and is arranged not to move downward as long as the stacker is positioned at the first position. Thus, the contact between the rigid medium and the recording head can be prevented during the recording operation. Therefore, the recording head can be prevented from being damaged and the carriage guide axis can be prevented from being moved down by the unexpected force externally applied.

Furthermore, the stacker has a function of the conventional feed-discharge tray for rigid material. Thus, it is unnecessary to use the feed-discharge tray, reducing the cost. In addition, since it is unnecessary to store the feed-discharge tray when the tray is not used, eliminating the trouble required for storing the feed-discharge tray.

The recording apparatus may further comprise a transfer-driven roller switching mechanism operable to switch the state of the transfer-driven roller between a contact state in which the transfer-driven roller is in contact with the transfer-driving roller and a cleared state in which the transfer-driven roller is moved upward, by operating an operating unit to cause the transfer-driven roller to be displaced.

According to this feature, since the transfer-driven roller switching mechanism is provided for switching the state of the transfer-driven roller between the contact state and cleared state by operating the operating unit, in a case of recording for paper, the paper can be transferred without fail by bringing the transfer-driven roller into the contact state. Moreover, in a case of recording the rigid medium, the rigid medium can be supplied to the position under the recording head by bringing the transfer-driven roller into the cleared state, thereby performing the recording without fail.

The transfer-driven roller switching mechanism may be arranged to be driven only when the stacker is positioned at the first position.

In a case of recording for the rigid medium such as CD-R, the stacker is placed at the first position first. Then, a CD-R tray in which the CD-R is mounted is placed on the medium-placed surface that is the top surface of the stacker. The CD-R is then fed manually from the front side of the printer. However, if the transfer-driven roller is in the contact state where it is in contact with the transfer-driving roller at this time, it is not possible to transfer the CD-R because the rollers of the transfer roller cannot sandwich the CD-R tray.

According to the present invention, the transfer-driven roller switching mechanism can be driven only when the stacker is positioned at the first position. Thus, after the stacker has been displaced to the first position, the transfer-driven roller switching mechanism is driven to place the transfer-driven roller in the cleared state and thereafter the CD-R is manually fed. Then, at least after the transfer roller has been placed in a state where the rollers of the transfer roller can sandwich the CD-R tray, the transfer-driven roller switching mechanism is driven to bring the transfer-driven roller into the contact state. As a result, the CD-R tray can be transferred without fail, while being sandwiched by the rollers of the transfer roller.

The recording apparatus may further comprise a regulating mechanism operable to regulate the driving of the discharge-driven roller switching mechanism in accordance with the position of the stacker.

According to this feature, since the regulating mechanism is provided for regulating the driving of the transfer-driven roller switching mechanism depending on the position of the stacker, it is possible to prevent wrong operation by the user. Also, it is possible to perform recording under the optimum condition for each of many types of recording media without fail.

The regulating mechanism may be arranged to place the transfer-driven roller only in the contact state when the stacker is positioned at the second position.

When the stacker is positioned at the second position, the medium for which recording is performed is fed from the feeder provided on the backside of the printer, is transferred to be subjected to the recording. After the recording, the medium is discharged and stacked onto the medium-placed surface of the stacker. In other words, as long as the stacker is positioned at the second position, it is not necessary to place the transfer-driven roller of the transfer roller in the cleared state.

According to the present invention, the transfer-driven roller can be in the contact state only, when the stacker is positioned at the second position. Thus, the transfer-driven roller can be prevented from being placed in the cleared state by mistake. If the transfer-driven roller is placed in the cleared state by mistake, the medium fed from the feeder cannot be transferred because the rollers of the transfer roller cannot sandwich the medium. That is, according to the present invention, the medium fed from the feeder, i.e., paper, can be transferred toward the stacker without fail.

The recording apparatus may further comprise a returning mechanism operable to affect the transfer-driven roller switching mechanism to bring the transfer-driven roller in the contact state when the stacker is displaced to the second position, in a case where the stacker is positioned at the first position and the transfer-driven roller is in the cleared state.

When the stacker is positioned at the second position, paper as the medium is fed from the feeder is stacked onto the medium-placed surface of the stacker after recording. That is, as long as the stacker is positioned at the second position, the transfer roller cannot transfer the rigid medium. Thus, it is necessary to place the transfer-driven roller in the contact state, not in the cleared state.

Therefore, according to the present invention, since the aforementioned returning mechanism is provided for affecting the transfer-driven roller switching mechanism, the transfer-driven roller can be placed in the contact state without fail as long as the stacker is positioned at the second position.

For example, a case is considered where the stacker is moved to the second position in order to perform recording for the medium from the feeder after the stacker was positioned at the first position and the recording was performed for the rigid medium. In this case, when the transfer-driven roller is in the cleared state, the transfer of this medium from the feeder may not be performed in an appropriate manner. However, according to the present invention, such a disadvantage can be prevented, and it is possible to place the transfer-driven roller in the contact state without fail when the stacker is displaced to the second position.

The returning mechanism may be formed by the same component as that forming the regulating mechanism. According to this feature, the recording apparatus can be formed by a simple arrangement and a reduced number of parts, thereby making the design easier and reducing the cost.

The carriage guide axis may be supported at its axis ends by a frame via an eccentric mechanism, the first link mechanism may include an actuation member engaged with the stacker; and a power transmission member operable to be driven together with the actuation member to cause the eccentric mechanism to pivotally move, and a gap between the recording head and the first or second type of medium may be adjusted by displacing the carriage guide axis together with the displacement of the stacker. According to this feature, the carriage can be displaced without fail by a simple arrangement.

The transfer-driven roller may be supported by a roller holder in such a manner that a downstream part of the transfer-driven roller is pivotable around an upstream portion of the transfer-driven roller as a pivot center, and the transfer-driven roller switching mechanism includes a cam rotation axis having a cam capable of coming into contact with the roller holder, and switches the cleared state and the contact state of the transfer-driven roller in accordance with the pivot of the roller holder by means of a cam mechanism operable to bring the cam into contact with a cam follower and to move the cam away from the cam follower by operating the operating unit, the cam follower being arranged in the upstream of the roller holder. According to this feature, the state of the transfer-driven roller can be switched between the cleared state and the contact state without fail by the simple arrangement.

The actuation member may include a space therein and has an U-shape that becomes convex upward seen from the downstream of the transfer path, the operating unit being arranged within the space.

According to this feature, the space in the recording apparatus can be reduced. Moreover, it is possible to cause the actuation member to serve as the regulating mechanism for regulating the driving of the operating unit without fail by the simple arrangement.

The transfer-driven roller switching mechanism may be capable of being driven together with the movement of the first link mechanism. According to this feature, only by displacing the position of the stacker by the user, for example, it is possible to appropriately set the recording condition.

According to the third aspect of the present invention, a liquid emitting apparatus comprises: a feeder operable to feed one or more units of a medium onto which liquid is to be emitted, one by one toward a downstream in a transfer path for transferring the medium, the feeder being provided in an upstream in the transfer path, the one or more units of the medium being stacked on the feeder at an angle; a liquid emitting head, provided in the downstream of the feeder, operable to emit the liquid; a carriage, on which the liquid emitting head is mounted, operable to reciprocate in a main scanning direction along a carriage guide axis; a transfer roller operable to transfer the medium by rotating, the transfer roller including a transfer-driving roller and a transfer-driven roller; a stacker, having a medium-placed surface, operable to be positioned at a first position allowing the medium from the medium-placed surface to be substantially horizontally fed to a position under the liquid emitting head and be substantially horizontally discharged from the position under the liquid emitting head onto the medium-placed surface, or at a second position for receiving the medium when the medium was fed by the feeder, the second position being located on a lower level than the first position, the medium-placed surface being arranged substantially horizontally when the stacker is positioned at the first position and is arranged at an angle when the stacker is positioned at the second position; and a first link mechanism operable to displace the stacker to cause the carriage guide axis to be displaced with the displacement of the stacker, wherein the carriage guide axis is arranged to be displaced upward when the stacker is positioned at the first position, and is prevented from moving downward as long as the stacker is positioned at the first position.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

In the following description, an embodiment of a liquid emitting apparatus according to the present invention is described referring to an ink-jet type printer that is an exemplary liquid emitting apparatus of the present invention, based on the drawings.

<Entire Arrangement of the Ink-Jet Type Printer>

Figure 1:
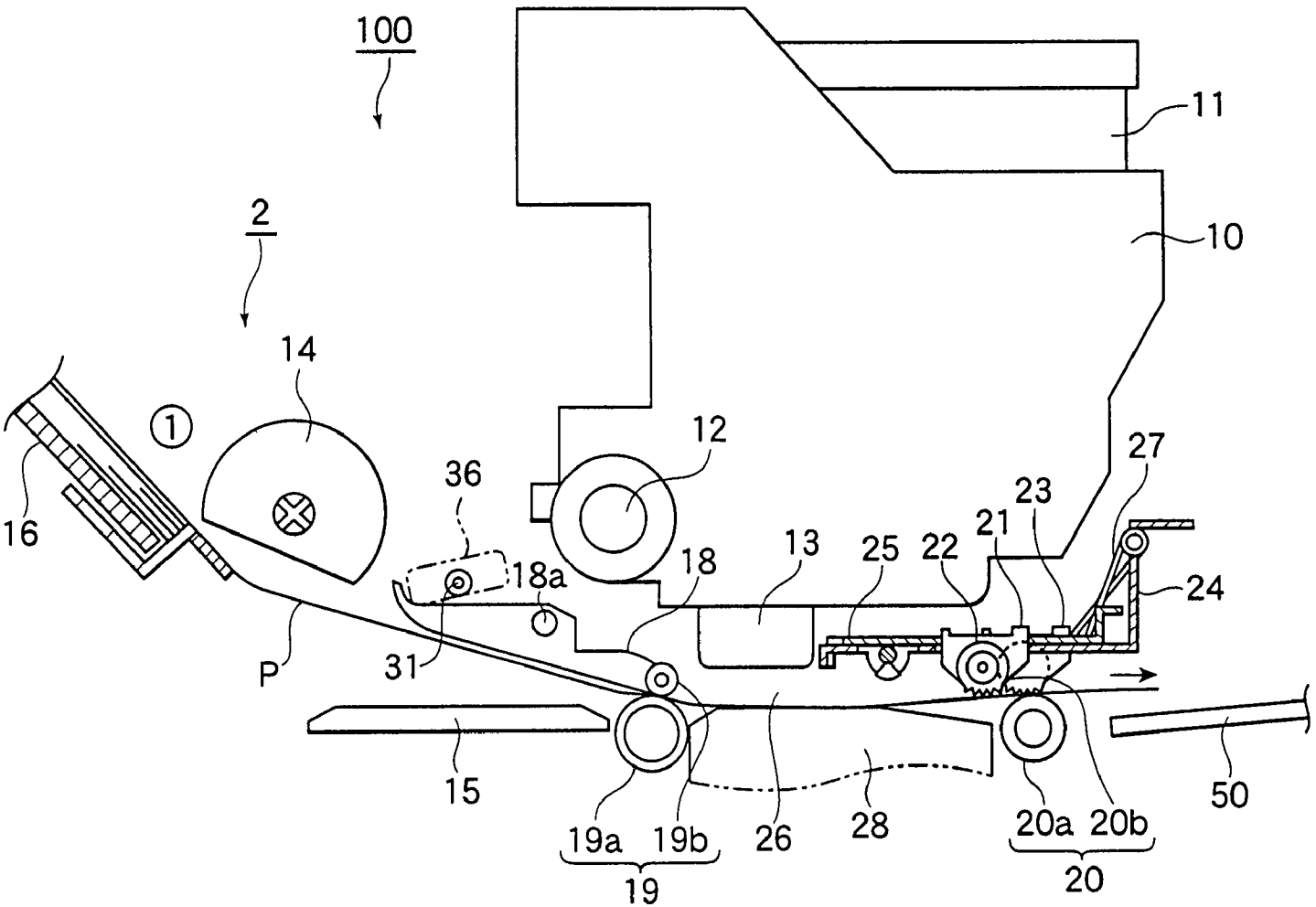
FIG. 1 is a cross-sectional view of a printer according to the present invention, seen from the side of the printer.
Figure 2:
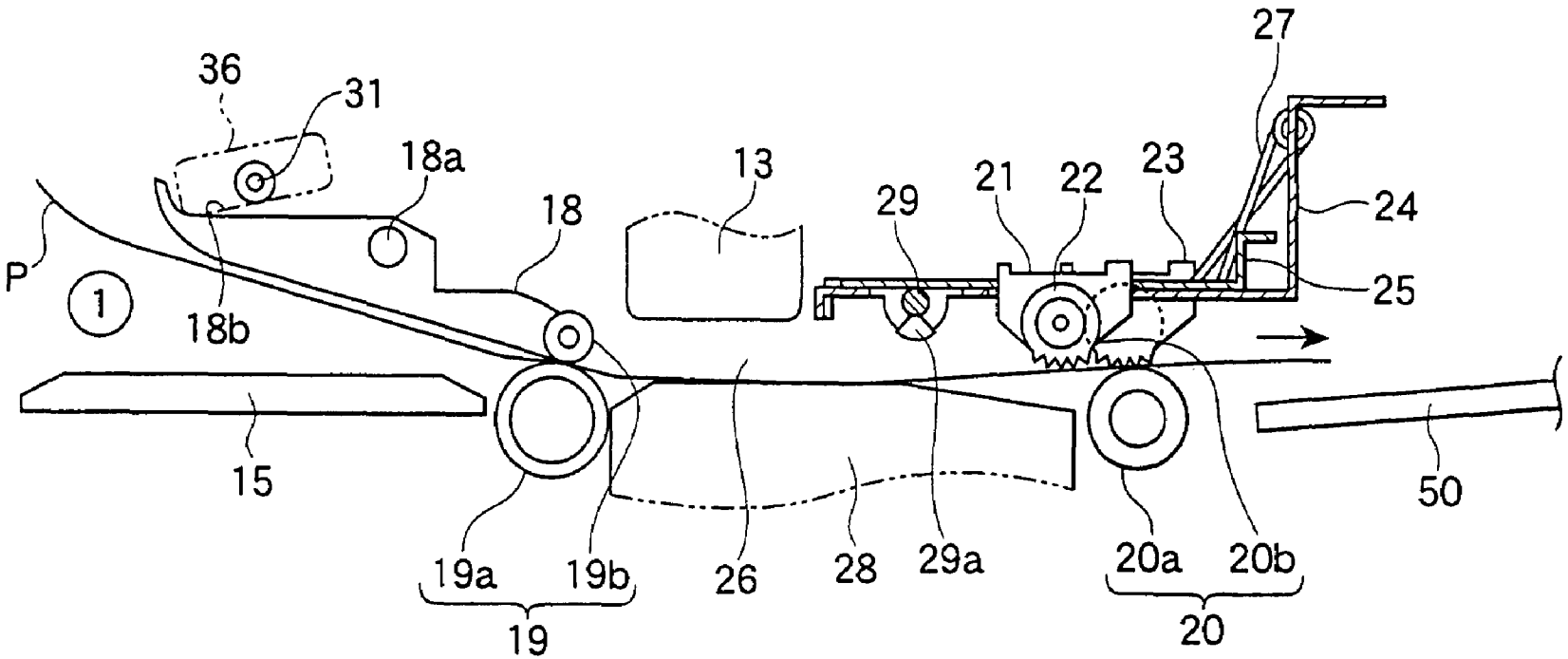
FIG. 2 is a cross-sectional view of the printer that performs recording on paper in a case where the first transfer path is used.
Figure 3:
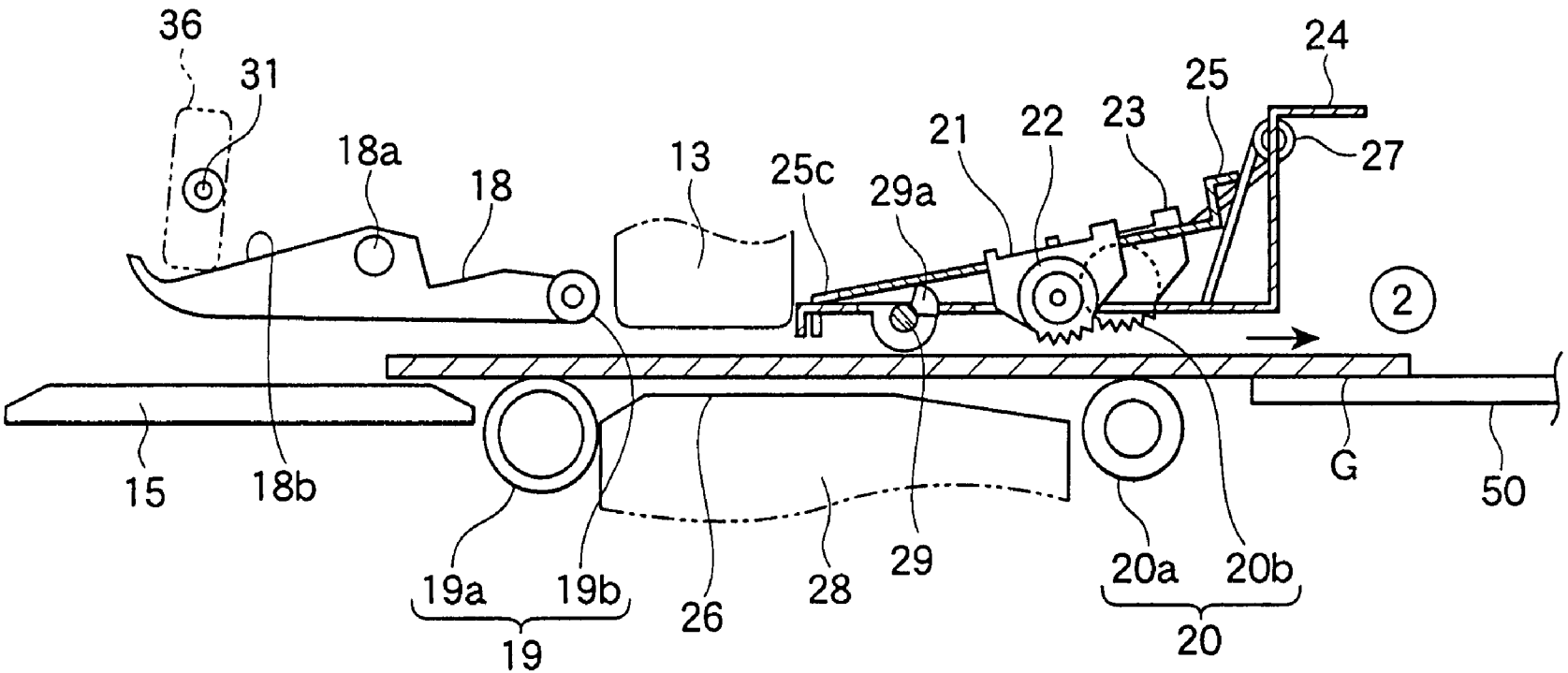
FIG. 3 is a cross-sectional view of the printer that performs recording on rigid recording medium in a case where the second transfer path is used.

Referring to FIGS. 1-3, an ink-jet type printer 100 (hereinafter, referred to as a "printer") as an exemplary recording apparatus according to an embodiment of the present invention is described. FIG. 1 is a cross-sectional view of the printer 100 seen from the side thereof; FIG. 2 is a cross-sectional view of the printer 100 showing a state in which printing is performed for paper by using the first transfer path (1); and FIG. 3 is a cross-sectional view of the printer 100 showing a state in which the printing is performed for a rigid medium by the second transfer path (2).

In this description, the term "paper P" is used for referring to a recording medium that can be fed by a feeder 2 as an exemplary feeding device while being bent; and the term "rigid medium G" is used for referring to a recording medium that cannot be fed while being bent. Moreover, in order to refer to both the paper P and the rigid medium G, the term "medium" may be used.

The printer 100 includes the first and second transfer paths (1) and (2). On the first transfer path (1), the feeder 2 for supplying paper P is provided in the upstream part of the printer 100. The feeder 2 holds one or more sheets of paper P stacked thereon at a certain angle with respect to the body of the printer 100 and feeds the paper P to the downstream one by one while bending the paper P, as shown in FIGS. 1 and 2. The paper P transferred on the first transfer path (1) is discharged from the front side of the printer 100 in a substantially horizontal direction. On the second transfer path (2), as shown in FIG. 3, a rigid medium G, that cannot be transferred on the first transfer path (1) because it cannot be bent, is substantially horizontally fed from the front side of the printer 100 and is then discharged from the front side of the printer 100.

First, a feeding operation using the first transfer path (1) is described referring to FIGS. 1 and 2. Operations of other components are also described referring to FIG. 3, if necessary.

The feeder 2 includes a hopper 16 on which one or more sheets of paper P are stacked. The hopper 16 holds the paper P at a certain angle with respect to the body of the printer 100. The hopper 16 has a pivot center (not shown) in the upstream part of the hopper 16, and can come into contact with a feeding roller 14 having a substantially D-shaped cross section and can move away from the feeding roller 14, by pivoting around the pivot center. When the hopper 16 pivots toward the feeding roller 14 to be in contact with the feeding roller 14, the paper P on the hopper 16 is pushed up, so that the uppermost sheet of the paper P is brought into contact with the feeding roller 14 while being pressed against the roller 14. The uppermost sheet of the paper P is then transferred toward the downstream in the first transfer path (1) by rotation of the feeding roller 14.

A paper guide 15 in form of plate is substantially horizontally arranged at a portion in the downstream of the feeding roller 14 under the first transfer path (1). When a top end of the paper P fed from the feeder 2 comes into contact with the paper guide 15, the paper P is bent smoothly so as to be directed toward the downstream in the transfer path (1).

A transfer roller 19 is arranged in the downstream of the paper guide 15, which includes a transfer-driving roller 19*a* that is driven to rotate by a driving section (not shown) and a transfer-driven roller 19*b* that is in contact with the transfer-driving roller 19*a* so as to be rotated by the rotation of the transfer-driving roller 19*a*. The paper P is sandwiched between the rollers 19*a* and 19*b* so as to be transferred toward the downstream by rotation of the rollers 19*a* and 19*b*. The transfer-driving roller 19*a* is formed by a bar-like roller extending in a main scanning direction. On the other hand, the transfer-driven roller 19*b* is relatively short in the main scanning direction. A plurality of transfer-driven rollers 19*b* are arranged in the main scanning direction at predetermined intervals.

The transfer-driven roller 19*b* is held by its axis by means of a roller holder 18 at the downstream part of the roller holder 18. The roller holder 18 is arranged to be pivotable around a pivot axis 18*a*, and is biased by a torsion coil spring (not shown) to be placed in a contact state where the transfer-driven roller 19*b* is always in contact with the transfer-driving roller 19*a* while being pushed toward the roller 19*a*. The contact state is described later.

The transfer-driven roller 19*b* is arranged to be placed in the contact state (see FIG. 2) where the transfer-driven roller 19*b* is in contact with the transfer-driving roller 19*a* or another state, i.e., a cleared state (see FIG. 3) where the transfer-driven roller 19*b* is moved upward so as to be away from the transfer-driving roller 19*a*. The two states of the transfer-driven roller 19*b* are switched by driving the second link mechanism as a roller-holder switching portion, detailed later, to cause the roller holder 18 to pivot around the pivot center 18*a*.

More specifically, a cam 36 is provided to a cam rotation axis 31 so as to be brought into contact with a cam follower 18*b* that is the upstream part of the roller holder 18, by rotation of the cam rotation axis 31. When the cam rotation axis 31 is rotated, the cam 36 comes into contact with the cam follower 18*b* from above, thereby pivotally moving the roller holder 18 around the pivot center 18*a*. Thus, the transfer-driven roller 19*b* is moved upward. This state is the cleared state shown in FIG. 3. When the cam 36 is moved away from the cam follower 18*b* by the rotation of the cam rotation axis 36, the roller holder 18 is caused to pivot by the torsion coil spring (not shown) in such a manner that the transfer-driven roller 19*b* is in contact with the transfer-driving roller 19*a* while being pressed against the roller 19*a*. This state is the contact state shown in FIG. 2. The arrangement of the second link mechanism for rotating the cam rotation axis 31 is detailed later in more detail.

On the downstream side of the transfer roller 19, a recording portion 26 for performing recording for a medium such as paper or a rigid medium is provided. In the recording portion 26, a platen 28 and a recording head 13 are arranged to be opposed to each other. The platen 28 is arranged to extend in the main scanning direction, thereby supporting the paper P transferred into the recording portion 26 from beneath the paper P.

The recording head 13 is provided at the bottom of a carriage 10 which can reciprocate in the main scanning direction while being guided by a carriage guide axis 12 extending in the main scanning direction. The carriage 10 also includes ink cartridges 11 storing a plurality of colors of ink, for example, yellow, magenta, cyan, black and the like, for realizing full-color printing.

A distance between the platen 28 and the recording head 13 (hereinafter, referred to as "PG") is a critical parameter that affects recording precision. Therefore, it is necessary to adjust that distance depending on the thickness of the recording medium. In order to achieve this, according to the present invention, the first link mechanism as a PG adjuster for displacing the carriage guide axis 12 in upward and downward directions is provided. The arrangement of the first link mechanism is described later.

A part of the printer 100 in the downstream of the recording portion 26 forms a discharging portion including a discharge roller 20. The discharge roller 20 has a discharge-driving roller 20*a* that is driven to rotate by a driving section (not shown) and a discharge-driven roller 20*b* that is in contact with the discharge-driving roller 20*a* so as to be rotated by rotation of the roller 20*a*. When the discharge-driving roller 20*a* is rotated in a normal direction (clockwise direction in FIG. 1) while sandwiching the paper P between the rollers 19*a* and 19*b*, the paper P is discharged onto a stacker 50.

The discharge-driven roller 20*b* is a toothed roller having teeth on its outer circumference, and is supported by a roller holder 23 in a rotatable manner. The roller holder 23 is fixed to a discharge-sub frame 25 in form of a plate elongate in the main scanning direction. The discharge-sub frame 25 extends substantially horizontally from a position in the vicinity of the recording head 13 in the downstream of the head 13 toward the downstream. The discharge-sub frame 25 is attached to a discharge main frame 24 that is a plate elongate in the main scanning direction and extends substantially horizontally from a position in the vicinity of the recording head 13 in the downstream of the head 13 toward the downstream, in such a manner that the frame 25 is pushed toward the frame 24 from above by means of a coil spring 27.

A discharge-assisting roller 22 is provided in the upstream of the discharge-driven roller 20*b* so as to press the paper P down. Moreover, the transfer-driven roller 19*b* is arranged in such a manner that the axis thereof is placed in the downstream of the axis of the transfer-driving roller 19*a*, and the discharge-driven roller 20*b* is arranged in such a manner that the axis thereof is placed in the upstream of the axis of the discharge-driving roller 20*a*. According to this arrangement, the paper P is bent to become convex downward between the transfer roller 19 and the discharge roller 20. Thus, the paper P located at a position opposed to the recording head 13 is pressed against the platen 28, thereby preventing the paper-P from being lifted up. As a result, the recording operation is performed normally.

The discharge-assisting roller 22 is formed by a toothed roller, like the discharge-driven roller 20*b*, and is supported by a roller holder 21. The roller holder 21 is fixed to the discharge-sub frame 25 in a similar manner to that of the discharge-driven roller 23 described above.

The discharge-sub frame 25 is arranged to be pivotable around a portion 25*c* in the upstream part of the frame 25 as a pivot center by rotation of a cam 29*a* provided to a holder rotation axis 29 described later, as shown in FIGS. 2 and 3. When the cam 29*a* is rotated to come into contact with the discharge-sub frame 25 from beneath the frame 25, the frame 25 is pivotally moved so that the downstream part of the frame 25 is elevated, as shown in FIG. 3. On the other hand, when the cam 29*a* is rotated to move away from the discharge-sub frame 25, the frame 25 is placed immediately above the frame 24 in such a manner that the frame 25 is parallel to the discharge main frame 24, as shown in FIG. 2.

According to this arrangement, the roller holder 23 for discharge-driven roller and the roller holder 21 for discharge-assisting roller are moved together with the discharge-sub frame 25, thereby moving the discharge-driven roller 20*b* and the discharge-assisting roller 22 upward to be cleared. Therefore, the following disadvantage that may be caused in a case where the recording medium is thick (rigid medium G), for example, a CD-R can be prevented. Since the discharge-driven roller 20*b* and the discharge-assisting roller 22 are toothed rollers as mentioned above, teeth of these rollers may come into contact with a recording surface of the CD-R to damage an information storage area of the CD-R formed immediately below the recording surface. However, according to the above arrangement for clearing the discharge-driven roller 20*b* and the discharge-assisting roller 22, the rollers 20*b* and 22 are moved upward to be cleared from the transfer path of the medium in a case of CD-R, thereby preventing the rollers 20*b* and 22 from coming into contact with the recording surface of the CD-R. In other words, depending the type of the medium, the state of the rollers 20*b* and 22 can be changed.

Then, the discharged paper P is stacked on the stacker 50 having a medium-placed surface 51 that is arranged at a certain angle with the body of the printer 100 (at the second position). This stacker 50 is arranged at the first position where the medium-placed surface 51 is substantially horizontal, in a case of recording for a rigid medium G. Arrangement and structure of the stacker 50 are described later.

<Arrangement of the First and Second Link Mechanisms>

Figure 4:
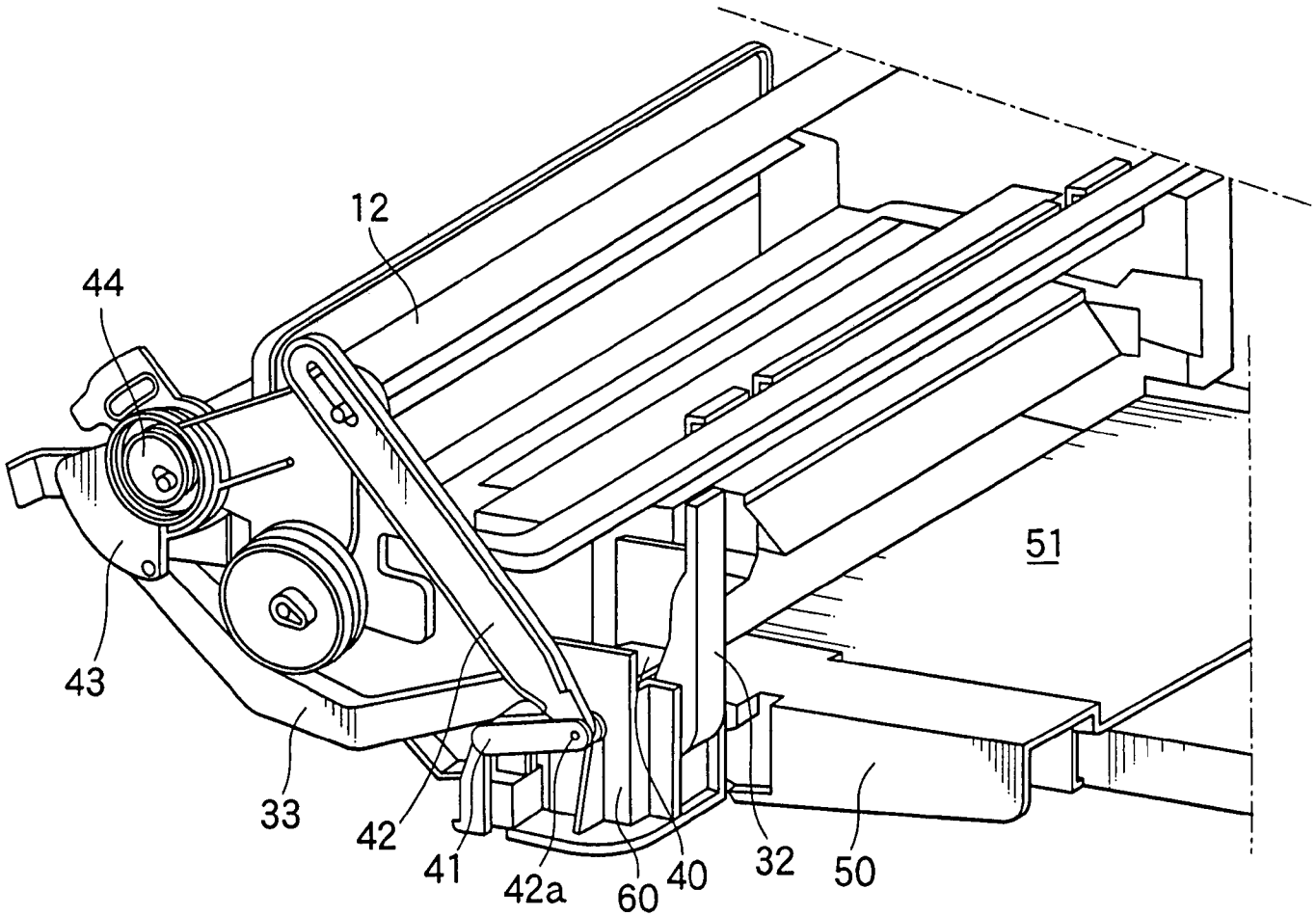
FIG. 4 is a perspective view of a main part of the printer seen from the front side of the printer.
Figure 5:
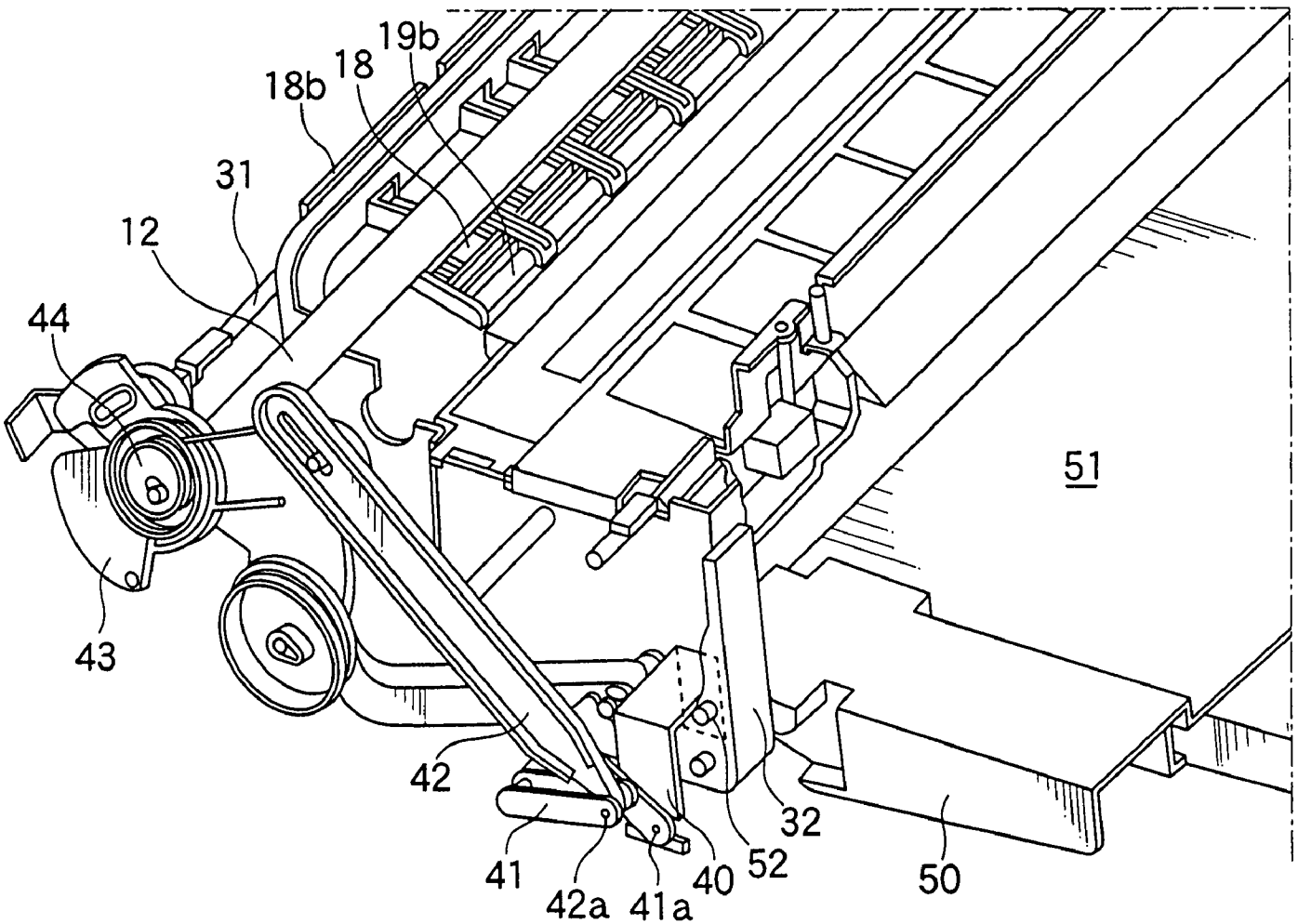
FIG. 5 is a perspective view of the main part of the printer seen from approximately the same direction as that in FIG. 4.
Figure 6:
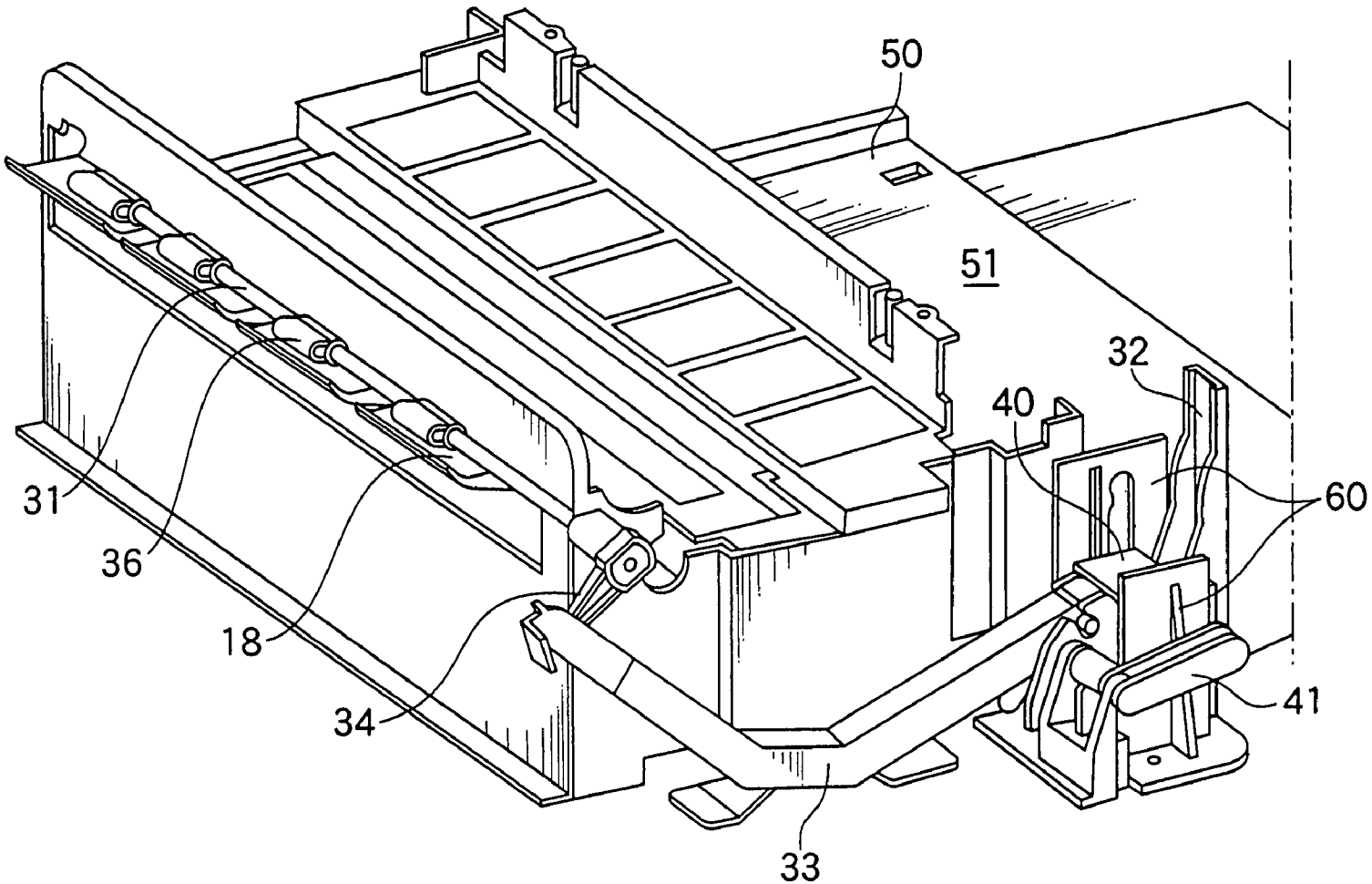
FIG. 6 is a perspective view of the main part of the printer seen from the backside of the printer.
Figure 7:
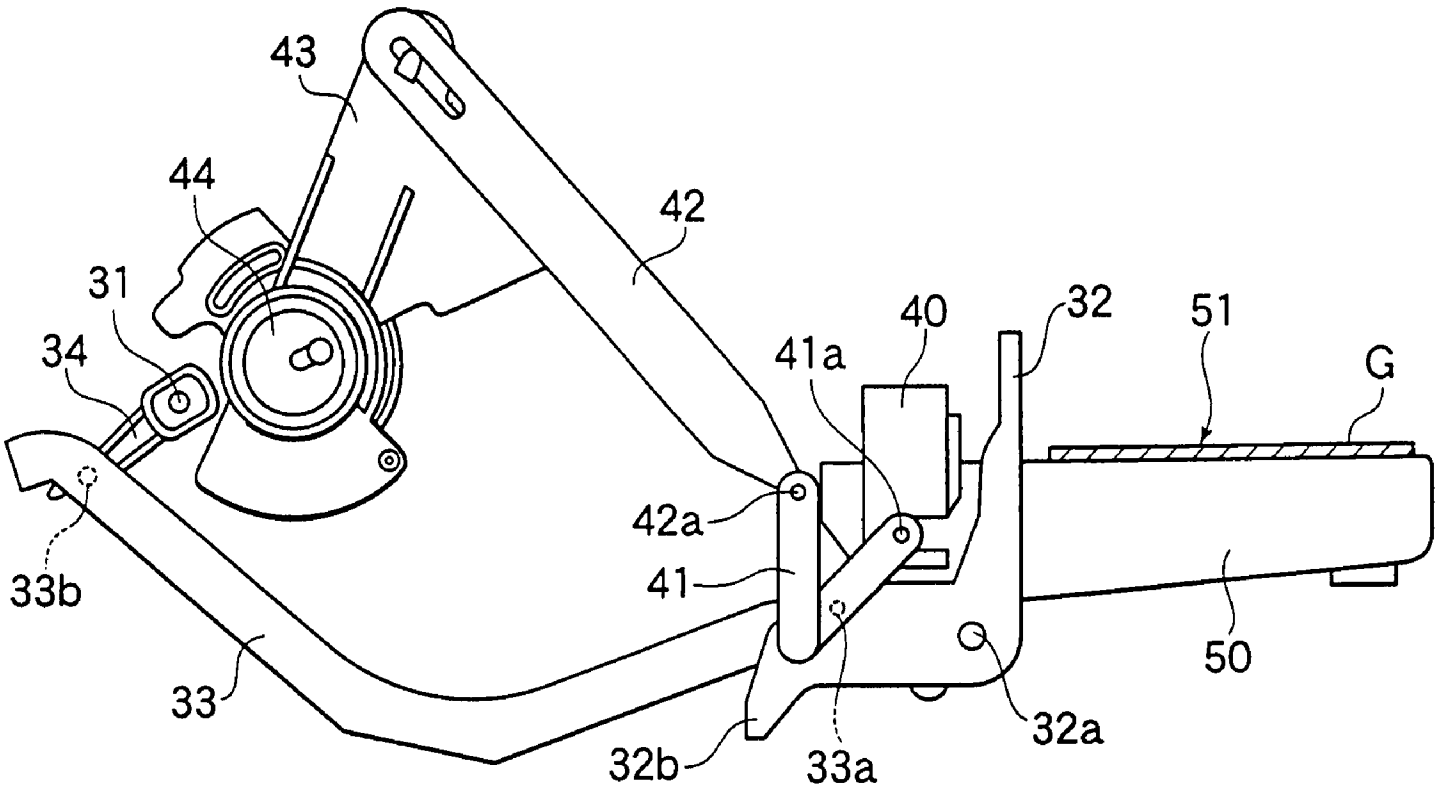
FIG. 7 is a cross-sectional view of the printer for explaining the first and second link mechanisms according to the present invention.
Figure 8:
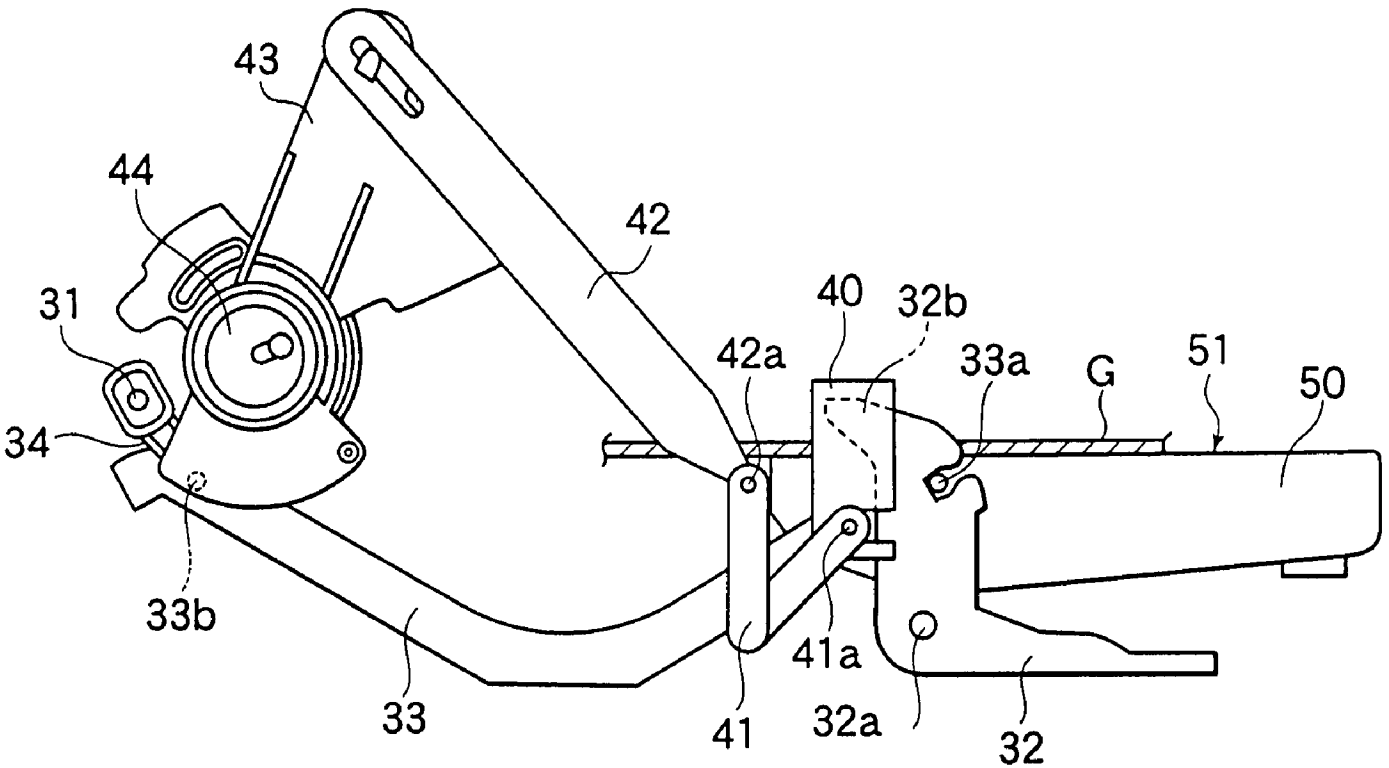
FIG. 8 shows an operation of the printer according to the present invention.
Figure 9:
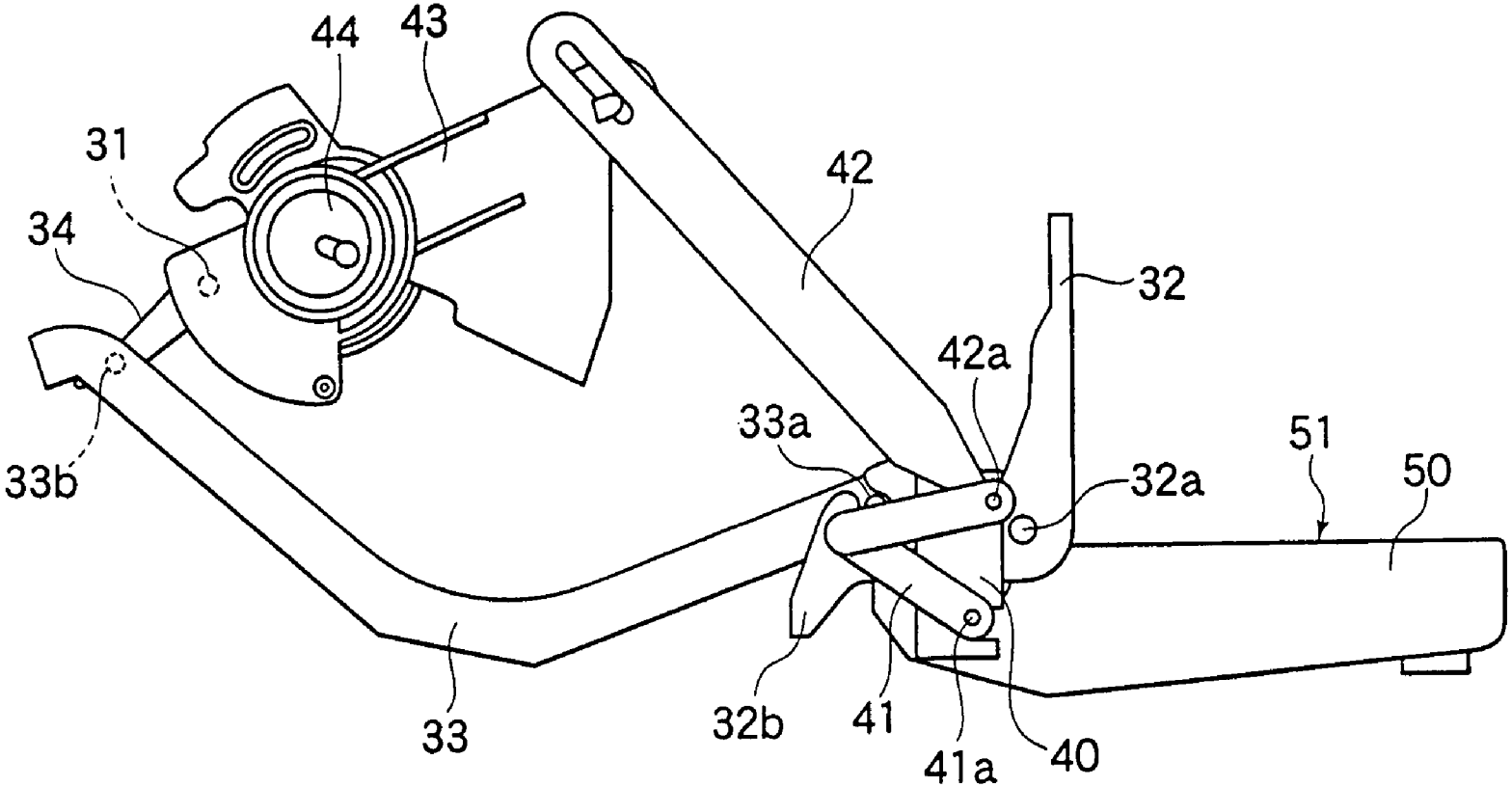
FIG. 9 shows an operation of the printer according to the present invention.
Figure 10A:
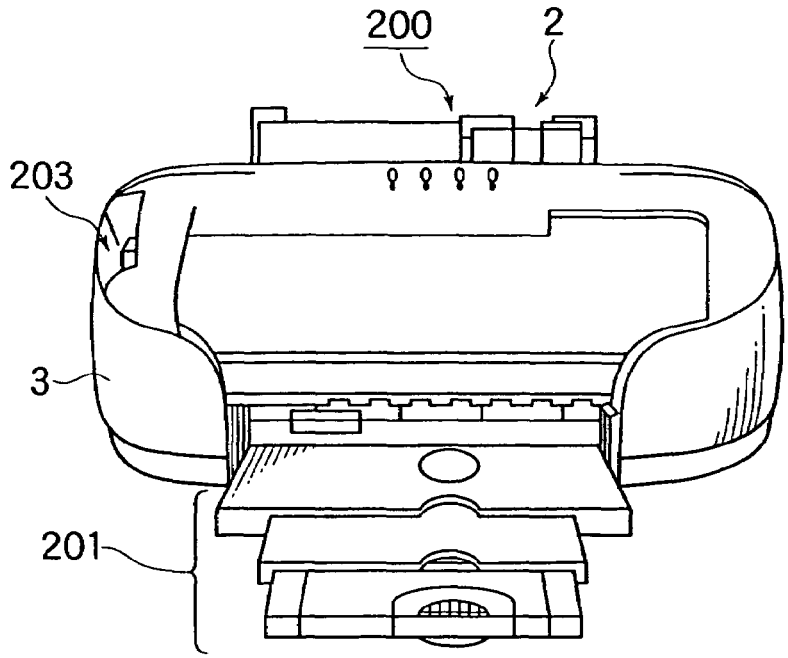
FIG. 10A is a front view of a conventional printer.
Figure 10B:
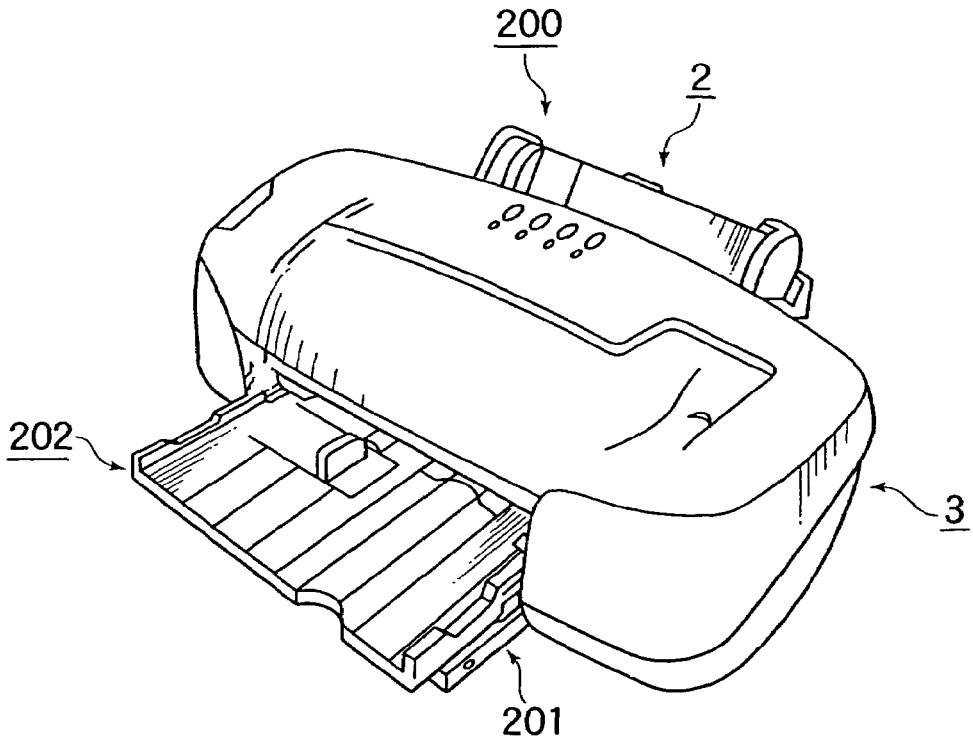
FIG. 10B is a perspective view of the conventional printer with a discharge tray for rigid medium attached thereto.

Next, the arrangement of the first and second link mechanisms is described referring to FIGS. 2-9. FIG. 4 is a perspective view showing a main part of the printer 100 seen from the front side of the printer 100; FIG. 5 is also a perspective view showing the main part of the printer 100 seen from approximately the same direction as that in FIG. 4; and FIG. 6 is a perspective view of the main part of the printer 100 seen from the backside of the printer 100. Moreover, FIG. 7 is a perspective view for explaining the first and second link mechanisms according to the present embodiment; and FIGS. 8 and 9 show operations of the first and second link mechanisms.

The printer 100 includes the first link mechanism for displacing the stacker 50 so as to displace the carriage guide axis 12 together with the stacker 50. Also, the printer 100 includes the second link mechanism for displacing the transfer-driven roller 19*b* by operation by an operation lever 32 as an operating portion, so as to switch the state of the transfer-driven roller 19*b* between the contact state (see FIG. 2) where the transfer-driven roller 19*b* is in contact with the transfer-driving roller 19*a* and the cleared state (see FIG. 3) where the transfer-driven roller 19*b* is cleared.

First, the first link mechanism is described.

The stacker 50 provided on the front side of the printer 100 is arranged at the first position (see FIG. 3) or the second position (see FIG. 2). When the stacker 50 is positioned at the first position, a straight transfer path can be formed in which a rigid medium G that cannot be fed by the feeder 2 is straightly fed from the medium-placed surface 51 that is substantially horizontal to a position under the recording head 13, and is then discharged from the position under the recording head 13 onto the medium-placed surface 51 straightly, as shown in FIG. 3. On the other hand, the second position is on the lower level than the first position. When positioned at the second position, the stacker 50 receives paper P that can be fed by the feeder 2 after the paper P was discharged, and stacks the paper P on the medium-place surface 51 at a certain angle with respect to the body of the printer 100, as shown in FIG. 2.

An engagement axis 52 is provided in the upstream part of the stacker 50 so as to project toward the side of the printer 100. The engagement axis 52 is engaged with a side of an actuation member 40 formed to have an U-shape that becomes convex upward when seen from the downstream side thereof. Thus, when the position of the stacker 50 is changed, the actuation member 40 is also displaced vertically with the displacement of the stacker 50. The actuation member 40 is guided at both sides thereof by a guide plate 60 fixed to a main frame (not shown), and can be displaced vertically along the inner surfaces of the guide plate 60.

Another side of the actuation member 40, that is an opposite side of the side engaged with the stacker 50, is engaged with the first transmission part 41 as a power transmission member for transmitting a power to a body of rotation 43 having an eccentric bush 44 that supports the carriage guide axis 12. The first transmission part 41 can pivot with respect to the actuation member 40 around an engaged portion 41*a* at which the part 41 is engaged with the actuation member 40. Moreover, the first transmission part 41 is engaged at an engaged portion 42*a* with the second transmission part 42 for connecting the first transmission part 41 to the body of rotation 43.

The body of rotation 43 supports the carriage guide axis 12 via the eccentric bush 44 at a position away from its center of rotation. Thus, when the body of rotation 43 is rotated by the switching operation by the stacker 50, the carriage guide axis 12 is displaced vertically, so that PG is adjusted.

More specifically, when the stacker 50 is positioned at the first position, the carriage guide axis 12 is displaced upward in the vertical direction so as to make PG larger. On the other hand, when the stacker 50 is positioned at the second position, the carriage guide axis 12 is displaced downward in the vertical direction so as to make PG smaller.

Next, the second link mechanism is described.

In the present embodiment, the transfer-driven roller 19*b* can be displaced substantially vertically by operating the operation lever 32 as an operating unit, so that the state of the transfer-driven roller 19*b* can be switched between the contact state where the roller 19*b* is in contact with the transfer-driving roller 19*a* (see FIG. 2) and the cleared position in which the roller 19*b* is moved upward to be cleared (see FIG. 3).

The operation lever 32 is arranged to be pivotable around an axis 32*a* as a pivot center and is engaged with the third transmission part 33 at an engaged portion 33*a* that is located in the upstream part of the operation lever 32. Moreover, the operation lever 32 is arranged to pivot with respect to the third transmission part 33 at the engaged portion 33*a*, when the operation lever 32 is pivotally moved around the axis 32*a*.

The third transmission part 33 is engaged in the upstream part thereof with the fourth transmission part 34 that supports a cam rotation axis 31. According to this arrangement, when the operation lever 32 is pivotally moved toward the downstream (in the clockwise direction), the third transmission part 33 is pulled toward the downstream side of the printer 100 so as to pivotally move the fourth transmission part 34 that supports the cam rotation axis 31. As a result, the cam 36 comes into contact with the roller holder 18 for supporting the transfer-driven roller 19*b*, thereby placing the transfer-driven roller 19*b* in the cleared state.

The operation lever 32 is arranged in a space within the actuation member 40 and therefore the rotation of the operation lever 32 is regulated when the stacker 50 is positioned at the second position. Only when the actuation member 40 is displaced upward, that is, only when the stacker 50 is positioned at the first position, the operation lever 32 can be operated.

More specifically, when the stacker 50 is positioned at the first position, the operation lever 32 can be operated, as shown in FIGS. 7 and 8, and therefore the transfer-driven roller 19*b* can be placed in the contact state or the cleared state. On the other hand, when the stacker 50 is positioned at the second position, the operation lever 32 is inoperative, as shown in FIG. 9, and therefore the transfer-driven roller 19*b* is placed in the contact state.

Next, driving of the first and second link mechanisms is described. For convenience, the driving of the first and second link mechanisms is described based on the operation of the stacker 50. The description is made referring to a case where the stacker 50 is moved from the second position (see FIG. 9) to the first position (see FIGS. 7 and 8) and another case where the stacker 50 is moved from the first position (see FIGS. 7 and 8) to the second position (see FIG. 9).

As shown in FIG. 9, when the stacker 50 is positioned at the second position, a top surface thereof, i.e., the medium-placed surface 51 is inclined. At this time, the carriage guide axis 12 is lifted down and the stacker 50 can receive and stack paper P that was discharged onto the medium-placed surface 51. Therefore, it is possible to perform printing for paper P transferred from the feeder 2 through the first transfer path, and the transfer-driven roller 19*b* is in the contact state where it is in contact with the transfer-driving roller 19*a*. Thus, the paper P is transferred to the recording portion 26 while being sandwiched by the rollers of the transfer roller 19, and is then stacked onto the medium-placed surface 51.

As described above, when the stacker 50 is positioned at the second position, the operation lever 32 is inoperative, that is, cannot be pivotally moved because of the actuation member 40. At this time, the upstream part of the operation lever 32, that is in the upstream of the axis 32*a*, is regulated to be inoperative by the actuation member 40 from above the operation lever 32. Therefore, it is impossible to operate the operation lever 32 to drive the second link mechanism. Thus, when the stacker 50 is positioned at the second position, the transfer-driven roller 19*b* is always placed in the contact state in which the transfer-driven roller 19*b* is in contact with the transfer-driving roller 19*a*.

By moving the stacker 50 upward to change the position of the stacker 50 to the first position (see FIG. 7), the actuation member 40 is also displaced upward. Thus, the engaged portion 41*a* at which the actuation member 40 and the first transmission part 41 are engaged with each other is also displaced upward, causing the first transmission part 41 to pivot toward the upstream side (in the counter-clockwise direction). This power is transmitted by the second transmission part 42 so as to rotate the body of rotation 43. As a result, the carriage guide axis 12, that is supported by the body of rotation 43 at the position away from the rotation center of body 43, is displaced upward in the vertical direction, thereby adjusting PG.

As described above, the upward displacement of the carriage guide axis 12 makes the distance between the recording headn13 and the platen 28 larger as compared with a case where the stacker 50 is positioned at the second position.

In addition, with the movement of the stacker 50 to the first position, the actuation member 40 is also displaced upward so that the regulation for the operation lever 32 by the actuation member 40 is released. Thus, the operation lever 32 becomes operative (see FIG. 7).

Then, by pivotally moving the operation lever 32 around the axis 32*a* as the pivot center toward the upstream side (in the clockwise direction), as shown in FIG. 8, the third transmission part 33 is pulled toward the downstream side, so that the fourth transmission part 34 that supports the cam rotation axis 31 is pivotally moved. As a result, the cam 36 comes into contact with the roller holder 18 for supporting the discharge-driven roller 19*b*, thereby moving the discharge-driven roller 19*b* to be placed in the cleared state.

In this manner, it becomes possible to manually feed a rigid medium G by using the second transfer path (2) on which the medium G is substantially horizontally fed from the medium-placed surface 51 of the stacker 50 to the recording portion 26 and is substantially horizontally discharged to the medium-placed surface 51. Moreover, by driving the second link mechanism to bring the transfer-driven roller 19*b* into the contact state after it became possible to sandwich the rigid medium G between the rollers of the transfer roller 19, the rigid medium G can be 5 transferred while being sandwiched between the rollers of the transfer roller 19.

After the recording, the rigid medium G is discharged onto the medium-placed surface 51 of the stacker 50 through the second 10 transfer path (2). In a case of successive recording for one or more units of rigid medium G, after one unit of rigid medium G was discharged, since the transfer-driven roller 19*b* is in the contact state, the second link mechanism is driven again to move the transfer-driven roller 19*b* to be placed in the cleared state. Then, next unit of rigid medium G is manually fed. Thus, when the stacker 50 is positioned at the first position, the printer 100 is arranged to allow the change of the state of the transfer-driven roller 19*b* appropriately by operating the operation lever 32 alone.

Next, when the stacker 50 is moved downward to change its position from the first position to the second position, this movement affects the first link mechanism. That is, the movement of the stacker 50 causes the actuation member 40 to move downward. 25 Therefore, the engaged portion 41*a* at which the actuation member 40 and the first transmission part 41 are engaged with each other is also displaced downward, so that the first transmission part 41 pivotally moves toward the downstream side (in the clockwise direction) around the engaged portion 41*a* as its pivot center. 30 This power generated by the pivot is transmitted to the second transmission part 42 so as to cause the body of rotation 43 to rotate, finally displacing the carriage guide axis 12 that is supported by the body of rotation 43 at the position away from the rotation center of the body 43, downward in the vertical direction.

When the stacker 50 is displaced from the first position to the second position, in a case where the operation lever 32 is in a state where it pivoted toward the upstream side, that is, where the transfer-driven roller 19*b* is placed in the cleared state, the displacement of the stacker 50 to the second position causes the actuation member 40 to affect as a returning mechanism on the second link mechanism, so that it is possible to place the transfer-driven roller 19*b* in the contact state.

More specifically, in a case where the stacker 50 is positioned at the first position and the transfer-driven roller 19*b* is in the cleared state, the operation lever 32 of the second link mechanism is at a position where the operation lever 32 reaches after it pivoted toward the upstream side, as shown in FIG. 8. At this time, the actuation member 40 as the returning mechanism is located above the upstream part 32*b* of the operation lever 32. When the stacker 50 is displaced from this state to be positioned at the second position, the actuation member 40 is also moved downward, so as to bias the upstream part 32*b* of the operation lever 32 from above the part 32*b*. Thus, the upstream part 32*b* of the operation lever 32 is also moved downward with the downward movement of the actuation member 40, thereby causing the operation lever 32 to pivotally move toward the upstream direction (in the counter-clockwise direction).

As described above, the actuation member 40 can affect the second link mechanism as the returning mechanism for returning the operation lever 32 and the regulating mechanism for regulating the driving of the second link mechanism, so as to bring the transfer-driven roller 19*b* in the contact state. In other words, when the stacker 50 is positioned at the second position, the transfer-driven roller 19*b* is always in the contact state where it is in contact with the transfer-driving roller 19*a*.

Moreover, it is possible to arrange the second link mechanism as the transfer-driven roller switching mechanism in such a manner that the second link mechanism works with the first link mechanism. In this case, it is possible for the user to appropriately set an optimum recording condition depending on the type of the medium for which the recording is performed only by operating the stacker 50.

As described above, according to the present invention, the first link mechanism for displacing the carriage guide axis together with the displacement of the stacker is provided. Therefore, it is possible to adjust PG depending on the type of the recording medium only by operating the stacker.

Although the present invention has been described by way of exemplary embodiments, it should be understood that those skilled in the art might make many changes and substitutions without departing from the spirit and the scope of the present invention which is defined only by the appended claims.

What is claimed is:

1. A recording apparatus comprising:

feeding means for feeding a medium to a downstream side of a transfer path;

a recording head, provided in the downstream of said feeding means, operable to perform recording for said medium;

a carriage, on which said recording head is mounted, operable to reciprocate in a main scanning direction along a carriage guide axis;

a transfer roller operable to transfer said of medium by rotating, said transfer roller including a transfer-driving roller and a transfer-driven roller;

a stacker having a medium-placed surface, said stacker being positioned at a first position allowing said medium to be substantially horizontally fed from said medium-placed surface to a position under said recording head and be substantially horizontally discharged from said first position under said recording head onto said medium-placed surface, or a second position operable to receive and stack said medium fed by the feeding means, said second position being on a lower level than said first position, said medium-placed surface being arranged substantially horizontally when said stacker is positioned at said first position and is arranged at an angle when said stacker is positioned at said second position; and first link means for displacing said stacker to cause said carriage guide axis to displace, wherein said carriage guide axis is arranged to be displaced upward when said stacker is positioned at said first position, and is prevented from moving downward as long as said stacker is positioned at said first position.

2. A recording apparatus for performing recording for a medium comprising a first type of medium and a second type of medium comprising:

feeding means for feeding said medium to a downstream side of a transfer path;

a recording head, provided in the downstream of said feeding means, operable to perform recording for said first type of medium and said second type of medium;

a carriage, on which said recording head is mounted, operable to reciprocate in a main scanning direction along a carriage guide axis;

a transfer roller operable to transfer said first type of medium by rotating, said transfer roller including a transfer-driving roller and a transfer-driven roller;

a stacker having a medium-placed surface, said stacker being positioned at a first position allowing another transfer path for said second type of medium to be formed or at a second position, located on a lower level than said first position, operable to receive and stack said first type-of medium, said medium-place surface being arranged substantially horizontally when said stacker is at said first position and is arranged at an angle when said stacker is at said second position, said another transfer path allowing said second type of medium to be straightly fed from said medium-placed surface to a position under said recording head and be straightly discharged from said position under said recording head onto said medium-placed surface; and first link means for displacing said stacker to cause said carriage guide axis to displace, wherein said carriage guide axis is displaced upward when said stacker is positioned at said first position, and is prevented from moving downward as long as said stacker is positioned at said first position, and said second type of medium is suitable for substantially straight transfer.

3. A recording apparatus as claimed in claim 1 or 2, further comprising a transfer-driven roller switching mechanism operable to switch the state of said transfer-driven roller (19*b*) between a contact state in which said transfer-driven roller is in contact with said transfer-driving roller and a cleared state in which said transfer-driven roller is moved upward, by operating an operating unit to cause said transfer-driven roller to be displaced.

4. A recording apparatus as claimed in claim 3, wherein said transfer-driven roller switching mechanism is arranged to be driven only when said stacker is positioned at said first position.

5. A recording apparatus as claimed in claim 4, further comprising a regulating mechanism operable to regulate the driving of a discharge-driven roller switching mechanism in accordance with the position of said stacker.

6. A recording apparatus as claimed in claim 5, wherein said regulating mechanism is arranged to place a discharge-driven roller only in a contact state when said stacker is positioned at said second position.

7. A recording apparatus as claimed in claim 4, further comprising a returning mechanism operable to affect said transfer-driven roller switching mechanism to bring said transfer-driven roller in said contact state when said stacker is displaced to said second position, in a case where said stacker is positioned at said first position and said transfer-driven roller is in said cleared state.

8. A recording apparatus as claimed in claim 7, wherein said returning mechanism is formed by the same component as that forming said regulating mechanism.

9. A recording apparatus as claimed in claim 4 wherein said transfer-driven roller is supported by a roller holder in such a manner that a downstream part of said transfer-driven roller is pivotable around an upstream portion of said transfer-driven roller as a pivot center, and said transfer-driven roller switching mechanism includes a cam rotation axis having a cam capable of coming into contact with said roller holder, and switches said cleared state and said contact state of said transfer-driven roller in accordance with the pivot of said roller holder by means of a cam mechanism operable to bring said cam into contact with a cam follower and to move said cam away from said cam follower by operating said operating unit, said cam follower being arranged in the upstream of said roller holder.

10. A recording apparatus as claimed in claim 9, wherein an actuation member includes a space therein and has an U-shape that becomes convex upward seen from the downstream of said transfer path, said operating unit being arranged within said space.

11. A recording apparatus as claimed in claim 4 wherein said transfer-driven roller switching mechanism is capable of being driven together with the movement of said first link means.

12. A recording apparatus as claimed in claim 3, wherein said operating unit of said transfer-driven roller switching mechanism is inoperable when said stacker is positioned at said second position.

13. A recording apparatus as claimed in claim 2 wherein said carriage guide axis is supported at its axis ends by a frame via an eccentric mechanism, said first link means includes an actuation member engaged with said stacker; and a power transmission member operable to be driven together with said actuation member to cause said eccentric mechanism to pivotally move, and a gap between said recording head and said first or second type of medium is adjusted by displacing said carriage guide axis together with the displacement of said stacker.

14. A liquid emitting apparatus comprising:

feeding means for feeding a medium to a downstream side of a transfer path;

a liquid emitting head, provided in the downstream of said feeding means, operable to emit a liquid;

a carriage, on which said liquid emitting head is mounted, operable to reciprocate in a main scanning direction along a carriage guide axis;

a transfer roller operable to transfer said medium by rotating, said transfer roller including a transfer-driving roller and a transfer-driven roller;

a stacker, having a medium-placed surface, operable to be positioned at a first position allowing said medium from said medium-placed surface to be substantially horizontally fed to a position under said liquid emitting head and be substantially horizontally discharged from said position under said liquid emitting head onto said medium-placed surface, or at a second position for receiving said medium when said medium was fed by said feeding means, said second position being located on a lower level than said first position, said medium-placed surface being arranged substantially horizontally when said stacker is positioned at said first position and is arranged at an angle when said stacker is positioned at said second position; and first link means for displacing said stacker to cause said carriage guide axis to displace, wherein said carriage guide axis is arranged to be displaced upward when said stacker is positioned at said first position, and is prevented from moving downward as long as said stacker is positioned at said first position.

15. A recording apparatus as claimed in claims 1, 2 or 14, wherein an axis of said transfer-driven roller is arranged upstream of an axis of said transfer-driving roller.

16. A recording apparatus as claimed in claims 1, 2 or 14, further comprising a discharge roller for discharging said medium, said discharge roller comprising a discharge-driving roller and a discharge-driven roller, wherein an axis of said discharge-driven roller is arranged upstream of an axis of said discharge-driving roller.

17. A recording apparatus as claimed in claim 16 further including a discharge-assisting roller for pressing said medium, wherein said discharge-assisting roller is supported by a first roller holder, and said discharge-driven roller is supported by a second roller holder fixed to a discharge sub-frame, wherein the first and second roller holders are moved together with the discharge sub-frame.

18. A recording apparatus comprising:

feeding means for feeding a medium to a downstream side of a transfer path;

a recording head, provided in the downstream of said feeding means, operable to perform recording for said medium;

a carriage, on which said recording head is mounted, operable to reciprocate in a main scanning direction along a carriage guide axis;

a transfer roller operable to transfer said medium by rotating, said transfer roller including a transfer-driving roller and a transfer-driven roller;

a stacker having a medium-placed surface, said stacker being positioned at a first position allowing said medium to be substantially horizontally fed from said medium-placed surface to a position under said recording head and be substantially horizontally discharged from said position under said recording head onto said medium-placed surface, or a second position operable to receive and stack said medium fed by the feeding means, said second position being on a lower level than said first position, said medium-placed surface being arranged substantially horizontally when said stacker is positioned at said first position and is arranged at an angle when said stacker is positioned at said second position; and first link means for displacing said stacker to cause said carriage guide axis to displace, wherein said stacker is positioned at said first position in accordance with an upward displacement of said carriage guide axis.

19. A recording apparatus comprising:

a feeder, provided in an upstream in a transfer path for transferring a medium, operable to feed said medium to a downstream in said transfer path one by one, said medium being stacked at a certain angle;

a recording head, provided in the downstream of said feeder, operable to perform recording for said medium; a carriage, on which said recording head is mounted, operable to reciprocate in a main scanning direction along a carriage guide axis; a transfer roller operable to transfer said medium by rotating, said transfer roller including a transfer-driving roller and a transfer-driven roller; and a stacker having a medium-placed surface, said stacker being positioned at a first position allowing said medium to be substantially horizontally fed from said medium-placed surface to a position under said recording head and be substantially horizontally discharged from said position under said recording head onto said medium-placed surface, or a second position operable to receive and stack said medium fed by the feeder, said second position being on a lower level than said first position, said medium-placed surface being arranged substantially horizontally when said stacker is positioned at said first position and is arranged at an angle when said stacker is positioned at said second position, wherein said stacker is positioned at said first position in accordance with an upward displacement of said carriage guide axis.

* * * * *